US006508675B1

(12) United States Patent
Korsunsky et al.

(10) Patent No.: US 6,508,675 B1
(45) Date of Patent: Jan. 21, 2003

(54) ELECTRICAL CONNECTOR CONFIGURED BY WAFERS INCLUDING MOVEABLE CONTACTS

(75) Inventors: Iosif Korsunsky, Harrisburg, PA (US); Wei-Chen Lee, Harrisburg, PA (US); Tod M. Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/222,264

(22) Filed: Aug. 15, 2002

Related U.S. Application Data

(62) Division of application No. 10/011,360, filed on Nov. 5, 2001, now Pat. No. 6,439,930.

(51) Int. Cl.[7] ..... H01R 24/00

(52) U.S. Cl. ..... 439/637; 439/701; 439/65; 439/60

(58) Field of Search ..... 439/637, 65, 608, 439/701, 60

(56) References Cited

U.S. PATENT DOCUMENTS

| | | | | |
|---|---|---|---|---|
| 4,780,095 A | * | 10/1988 | Classon et al. | 439/637 |
| 4,904,197 A | * | 2/1990 | Cabourne | 439/637 |
| 5,993,259 A | * | 11/1999 | Stokoe et al. | 439/608 |
| 6,083,047 A | * | 7/2000 | Paagman | 439/608 |

* cited by examiner

*Primary Examiner*—Tho D. Ta
(74) *Attorney, Agent, or Firm*—Wei Te Chung

(57) ABSTRACT

An electrical system includes a first substrate (31) having a first contact portion (32, 33) thereon and a second substrates (35) having a second contact portion (36, 37) thereon. An electrical connector is arranged between the first and second substrates for establishing electrical connection therebetween. The electrical connector includes a number of wafers (10) stacked together and each wafer includes at least a passageway (13, 14) defined therein having ends facing the first and second substrates. Each passageway has a terminal (21, 22) moveably supported therein and has end contacting portions **(21*b*, 21*c*; 22*b*, 22*c*) electrically contacting with first and second contact portions of said first and second substrates. The terminal includes an arm (21*d*, 22*d*)** abutting against an inner side of the passageway.

3 Claims, 9 Drawing Sheets

ELECTRICAL CONNECTOR CONFIGURED BY WAFERS INCLUDING MOVEABLE CONTACTS

CROSS-REFERENCE TO RELATED APPLICATION

This patent application is a division of the U.S. application, Ser. No. 10/011,360, filed on Nov. 5, 2001, U.S. Pat. No. 6,439,930, entitled "ELECTRICAL CONNECTOR CONFIGURED BY WAFERS INCLUDING MOVEABLE CONTACTS", assigned to the same assignee as the present application.

BACKGROUND OF THE INVENTION

1. Field of the Invention

The present invention generally relates to an electrical connector, and more particularly to an electrical connector configured by wafers including moveable contacts thereby featuring simple, reliable connections.

2. Description of Prior Art

Making an electrical connector by means of wafers has been known to the industry. However, all contacts are fixedly and securely attached to a wafer, typically as disclosed as below.

U.S. Pat. No. 5,993,259 issued to Stokoe et al. discloses an electrical connector of such application. The connector disclosed in the '259 patent includes a plurality of modularized wafers bounded together. As shown in FIG. 4 of the '259 patent, the terminals are stamped from a metal sheet, then embedded within an insulative material to form the wafer.

U.S. Pat. No. 6,083,047 issued to Paagman discloses an approach to make a high-density connector by introducing the use of printed circuit board. According to teaching of the '048 patent, conductive traces are formed on surfaces of the printed circuit board in a mirror-image arrangement, typically shown in FIG. 12.

As known to the skilled in the art, electrical connection between two terminals is generally facilitated by normal force exerted from one terminal to the other. However, since surface of the terminal could be contaminated by dust or oxidation, it is preferable to generate a wiping displacement between two terminals during mating. With the wiping displacement between the terminals, dust or oxidation on the terminal could be wiped out, thereby ensuring reliable electrical connection between two mated terminals.

The suggestions disclosed above have solder tails soldered to the printed circuit board, while connecting portions make connection through wiping.

In addition, since the terminals are fixedly embedded to the wafer, normal force provided by the terminals is then fixed.

Another problem of the prior art is that during the engagement of the terminals and the printed circuit board, there is a possibility of collapse of the terminals because an end of the terminal is soldered to the printed circuit board, especially to the terminals with tiny configuration and dimension. In addition, conventional arrangement of the terminal is always parallel to direction of the inserted printed circuit board.

Co-pending U.S. patent application entitled to "Electrical Connector", commonly assigned to the same assignee and filed on May 15, 2001, Ser. No. 09/858,841, discloses an electrical connector having terminals moveably mounted on terminal supports. The specification is attached as for reference.

BRIEF SUMMARY OF THE INVENTION

Accordingly, it is an object of the present invention to provide an electrical connector configured by a plurality of wafers. The number of wafers can be increased accordingly to meet different applications.

Another object of the present invention is to provide a wafer in which terminals are dynamically received within passageways thereof thereby properly avoiding collapse of the terminals by movement of the terminal within the passageway.

In order to achieve the above-mentioned objects, an electrical system in accordance with the present invention includes a first substrate having a first contact portion thereon and a second substrate having a second contact portion thereon. An electrical connector is arranged between the first and second substrates for establishing electrical connection therebetween. The electrical connector includes a plurality of wafers stacked together and each wafer includes at least a passageway defined therein having ends facing the first and second substrates. Each passageway has a terminal moveably supported therein and has end contacting portions electrically contacting with the first and the second contact portions of said first and second substrates. The terminal includes an arm abutting against an inner side of the passageway.

Other objects, advantages and novel features of the invention will become more apparent from the following detailed description of the present embodiment when taken in conjunction with the accompanying drawings.

DETAILED DESCRIPTION OF THE INVENTION

Figure 1:
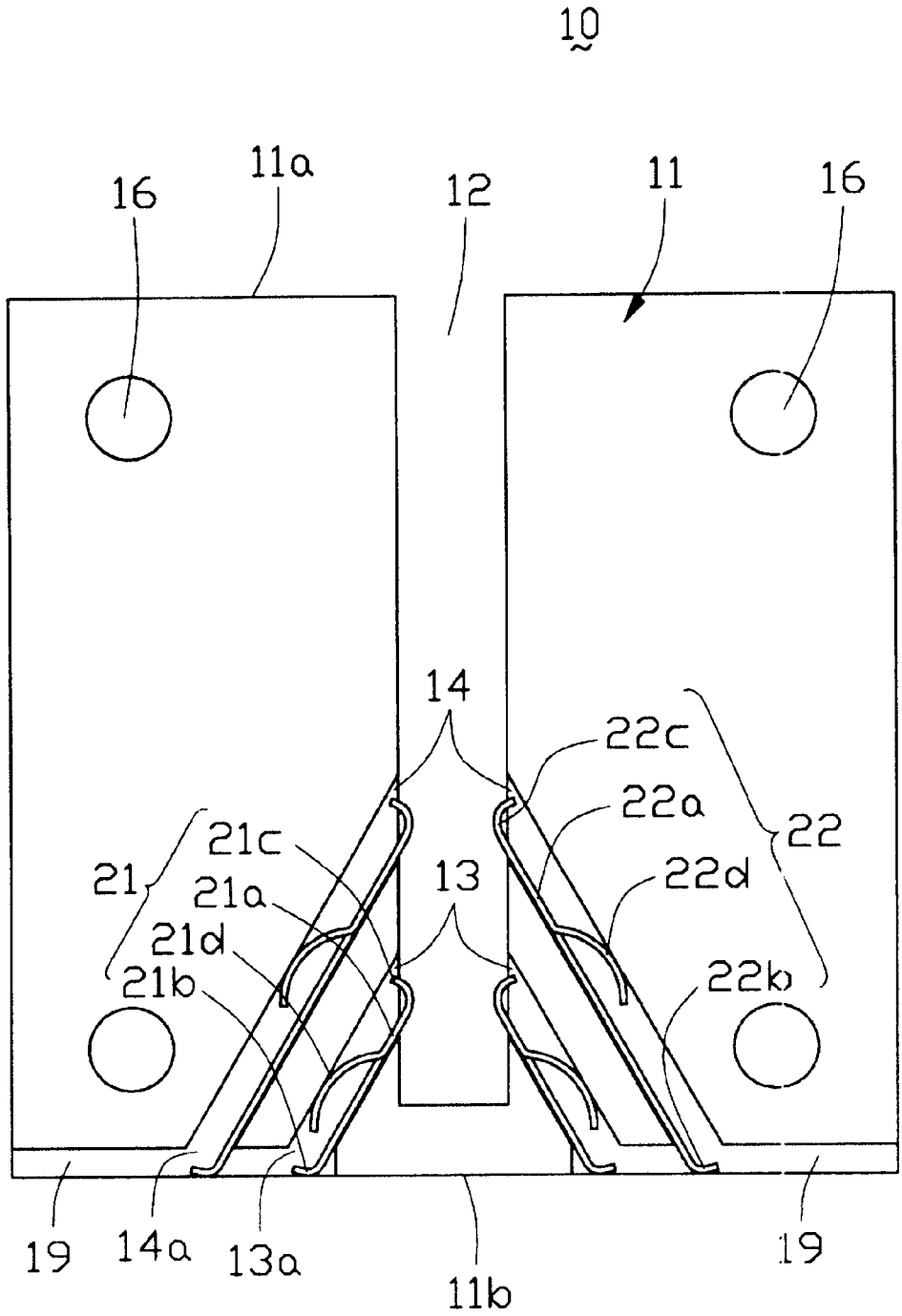
FIG. 1 is a front view of a wafer in accordance with the present invention before a daughter card is inserted.

Reference will now be made to the drawing figures to describe the present invention in detail.

Figure 2:
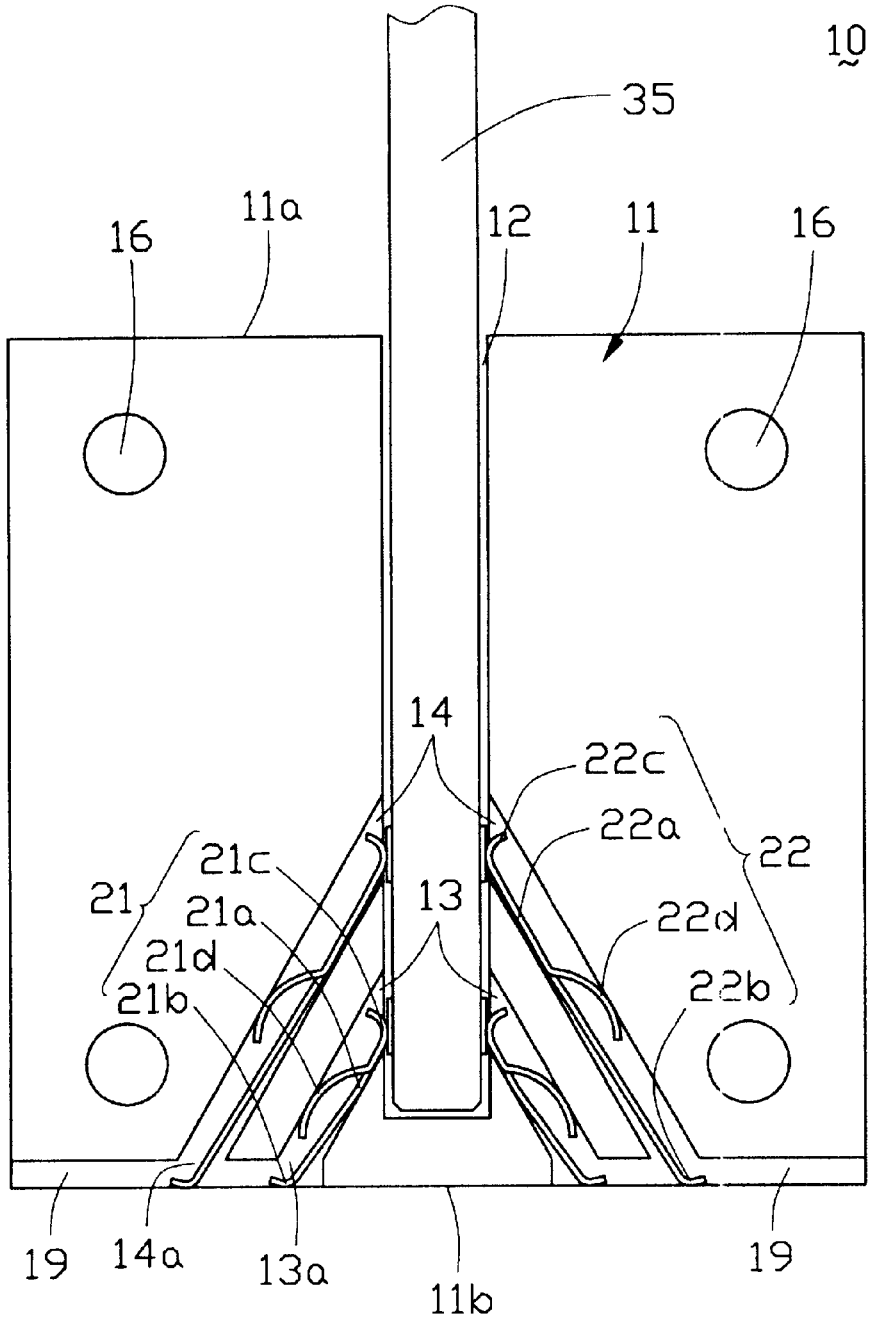
FIG. 2 is a view similar to FIG. 1 while with the daughter card inserted.

Referring to FIGS. 1 and 2, a wafer 10 in accordance with the present invention comprises a base portion 11, of a desired thickness, having a card receiving passageway 12 extending from a top surface 11*a* thereof. The base portion 11 further defines first and second passageways 13, 14, which are symmetrically arranged with respect to the card receiving passageway 12 and extend into a bottom surface 11*b* of the base portion 11. The base portion 11 further defines a recess 19 extending upward from the bottom surface 11*b* and merging with end portions 13*a*, 14*a* of the passageways 13, 14.

First and second terminals 21, 22 are received in the passageways 13, 14, respectively. The terminal 21 (22) includes a base portion 21*a* (22*a*), first and second contact portions 21*b*, 21*c* (22*b*, 22*c*). Each terminal 21 (22) further includes an arm 21*d* (22*d*) extending from the base portion 21*a* (22*a*), respectively. The length of the terminal 21 (22) is arranged longer than the length of the passageway 13 (14). As it can be readily seen from FIG. 1, the first contact portion 21*b* (22*b*) of the terminal 21 (22) extends into the recess 19 and flush to the bottom surface 11*b*, while the second contact portion 21*c* (22*c*) extends into the card receiving passageway 12.

In practice, the bottom surface 11*b* is rested on a mother board 31 (FIG. 5B to 5C) on which conductive pads 32, 33 are provided. When the wafer 10 is securely mounted onto the mother board 31, the first contact portions 21*b*, 22*b* are in contact with the conductive pads 32, 33 respectively, while the second contact portions 21*c*, 22*c* extend into the card receiving passageway 12.

When a daughter card 35 having conductive pads 36, 37 (FIG. 5A) thereon is inserted into the card receiving passageway 12 and in contact with the second contact portions 21*c*, 22*c*, the terminals 21, 22 are forced to move along the passageways 13, 14, respectively, such that the first contact portions 21*b*, 22*b* wipe over the conductive pads 32, 33. In addition, since the second contact portions 21*b*, 22*b* are driven into the passageways 13, 14, the second contact portions 21*c*, 22*c* wipe over the conductive pads 36, 37, respectively. Accordingly, reliably electrical connections between the contact portions 21*b*, 22*b*, 21*c*and 22*c* and the conductive pads 32, 33, 36 and 37 are achieved.

In addition to the wiping motion occurring between the first and second contact portions 21*b*, 22*b*, 21*c* and 22*c* and the conductive pads 32, 33, 36 and 37, dynamic motion of the terminals 21, 22 within the passageways 13, 14 can also effectively reduce the possibility of the collapse of the terminals 21, 22 during the engagement with the daughter card 35. As shown in FIG. 1, prior to the engagement, the base portion 21*a*, 22*a* of the terminals 21, 22 are straight. During the engagement, the base portion 21*a* deforms such that the first contact portions 21*b*, 22*b* wipes over the conductive pads 32, 33 thereby preventing terminals 21, 22 from stubbing and yielding, as shown in FIG. 2. Without this dynamic motion and subsequent wiping action of the first contact portions 21*b*, 22*b* with respective to the conductive pads 32, 33, it is possible that the terminals 21, 22 may stub, yield and collapse. In addition, the provision of the arms 21*d*, 22*d* will also force the base portions 21*a*, 22*a* back to its original position once the daughter card 35 is withdrawn from the card receiving passageway 12. This results in excellent mechanical performance even though the size of the terminals 21, 22 can be quite small.

In addition, since the passageways 13, 14 are in slant arrangement and the terminals 21, 22 are obliquely supported in the passageways 13, 14, the first contact portions 21*b*, 22*b* contact the conductive pads 32, 33 angularly. Accordingly, the wiping motion of the first contact portions 21*b*, 22*b* with respect to the conductive pads 32, 33 occurs without causing excess stress to the terminals 21, 22 thereby properly avoiding permanent deformation of the terminals 21, 22.

Furthermore, the provision of the recess 19 release the extension of the first contact portions 21*b*, 22*b* of the terminals 21, 22. As the second contact portions 21*c*, 22*c* of the terminals 21, 22 displace normal to the daughter card they retreat into the passageways 13, 14 while engaging with the daughter card 35. This forces the first contact portions 21*b*, 22*b* to extend into the recess 19. Without the provision of the recess 19, the wiping motion is limited to a short distance, while with the provision of the wiping movement, the wiping movement of the contact portions 21*b*, 22*b* can be properly extended. However, the recess 19 can also be replaced by an enlarged portion of each passageways 13, 14.

Figure 6:
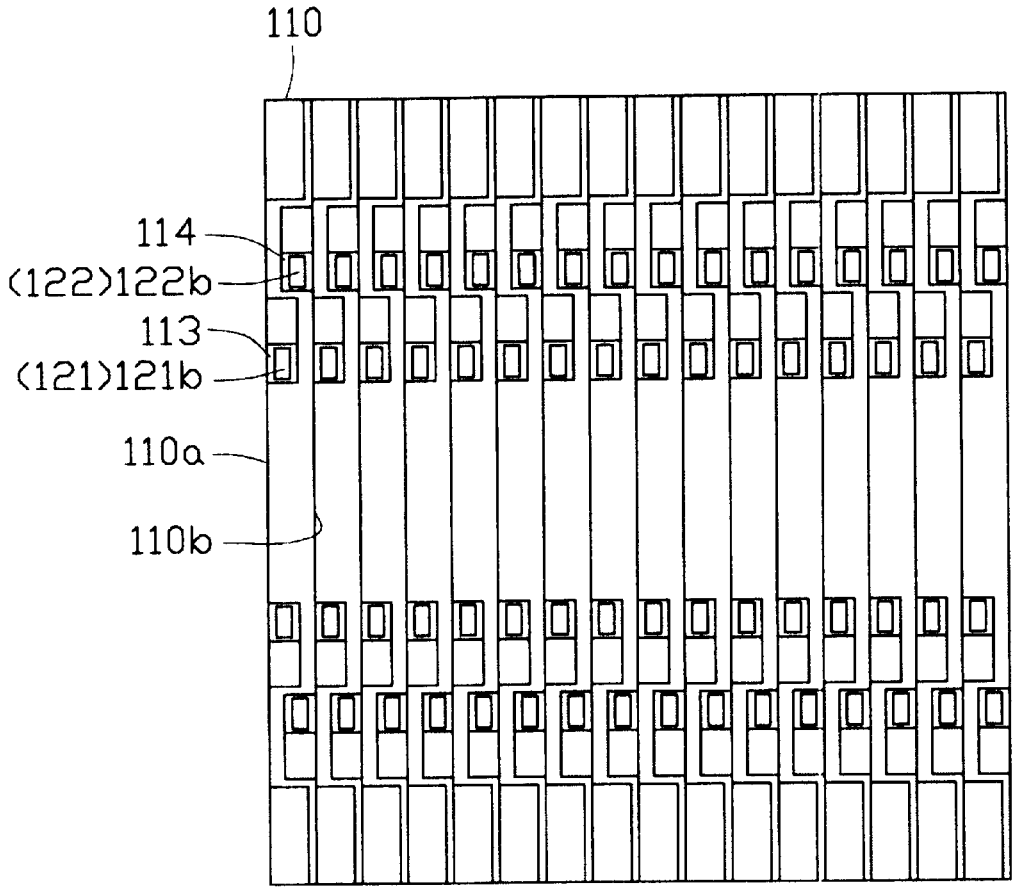
FIG. 6 is a bottom view of a wafer in accordance with a second embodiment of the present invention.
Figure 7:
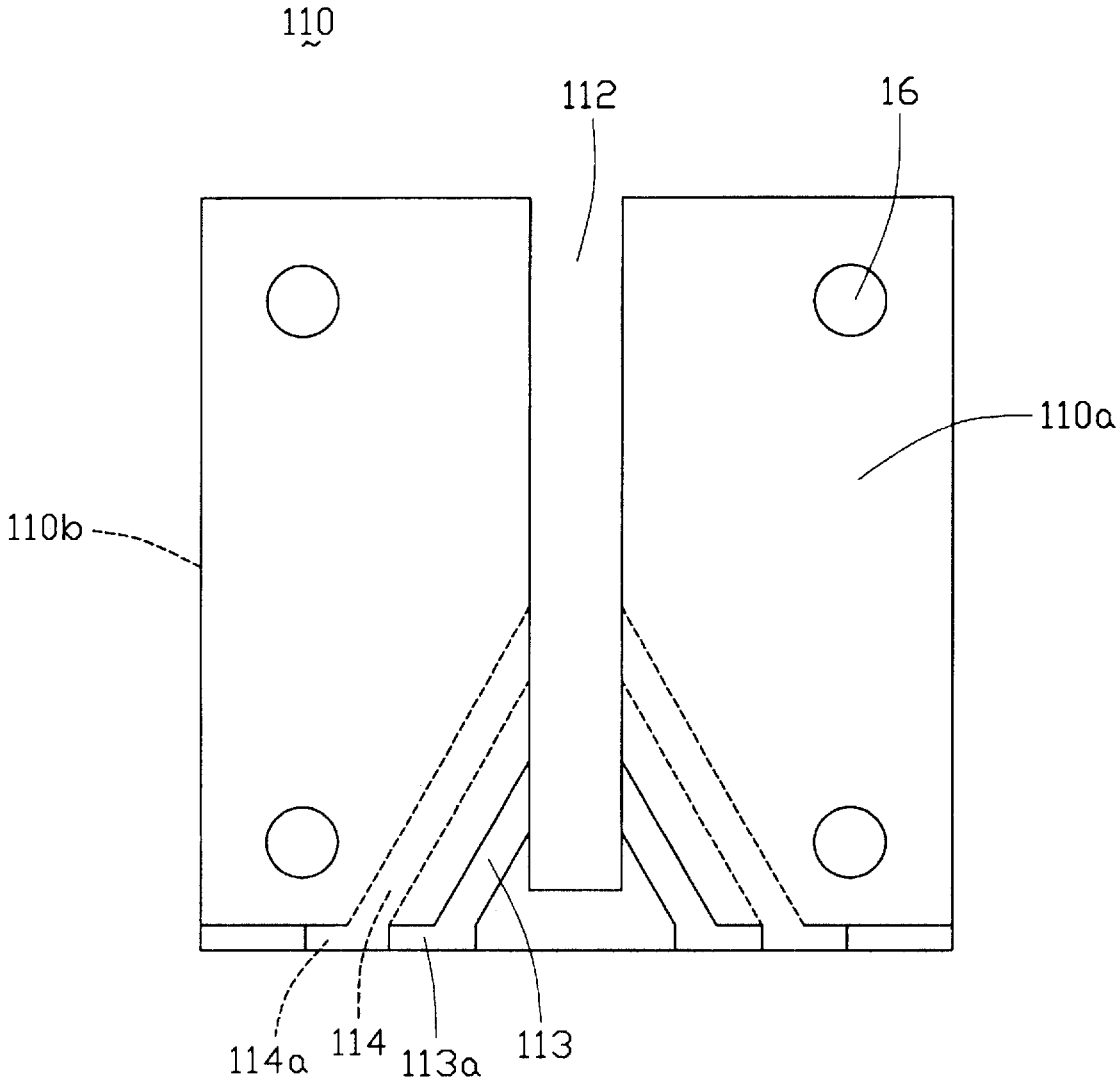
FIG. 7 is a front view of FIG. 6.

In the above described embodiment, the passageways 13, 14 are arranged in the same plane, while in a second embodiment, the passageways 113, 114 can be arranged oppositely on first and second surfaces 110*a*, 110*b* of a wafer 110 according to a second embodiment of the present invention. Each passageway 113 (114) is provided with an enlarged portion 113*a* (114*a*) for extension of contact portions 121*b* (122*b*) of the terminals 121 (122), as clearly shown in FIGS. 6 and 7. The terminals 21, 22 assembled therein are same as the first embodiment. The wafer 110 also defines a card receiving passageway 112 for receiving a daughter card therein.

Figure 3:
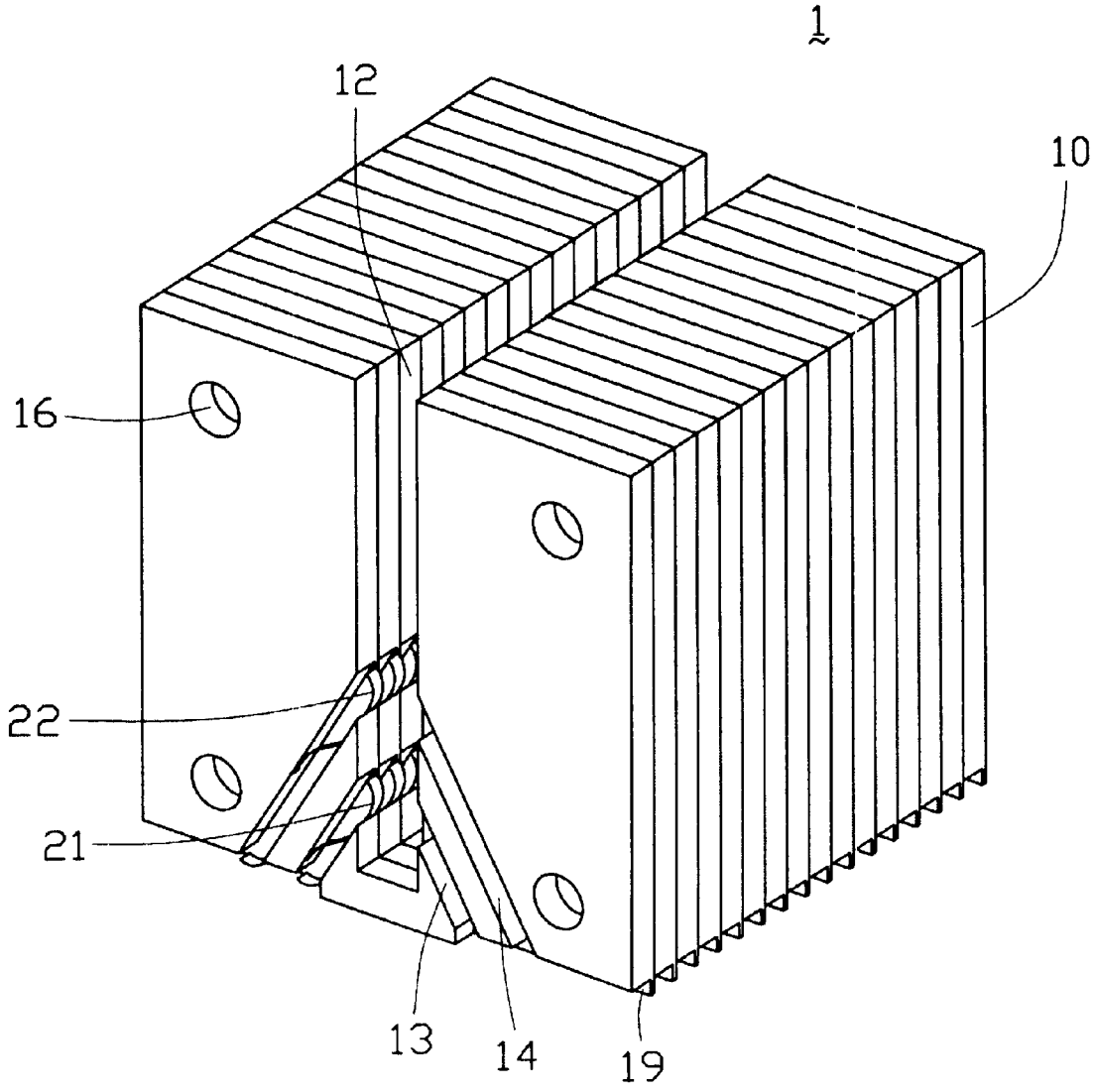
FIG. 3 is a perspective view of a connector configured by sixteen wafers of FIG. 1.
Figure 4:
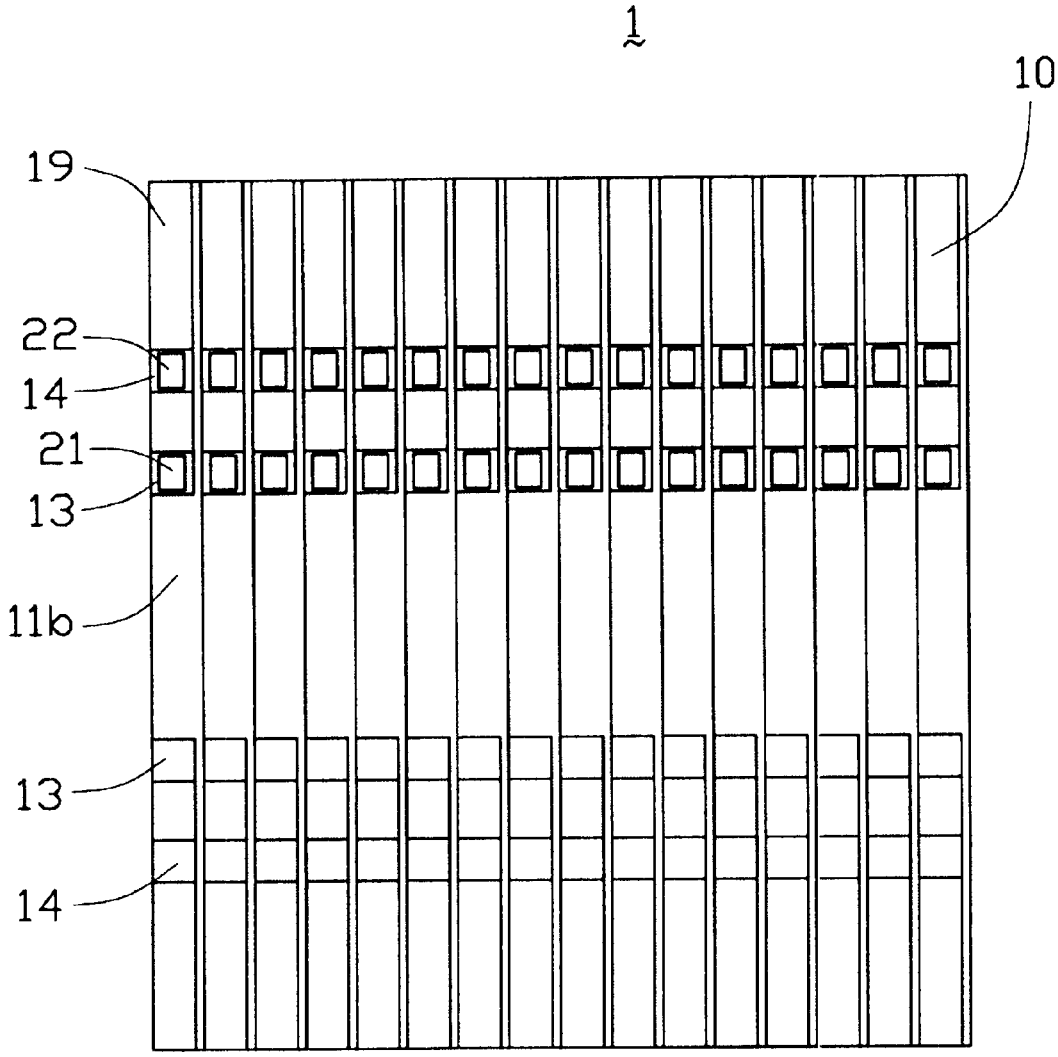
FIG. 4 is a bottom view of FIG. 3.

FIGS. 3 and 4 are views showing a connector 1 configured by sixteen wafers 10 disclosed above. As it can be readily seen, the wafer 10 is defined with holes 16. When the wafers 10 are assembled, a fastening device (not shown) can extend through to each hole to securely attach the wafers 10 together. Similarly, many external geometric shapes attached to each wafer would provide alternative methods of attaching the wafers 10 together.

Figure 5A:
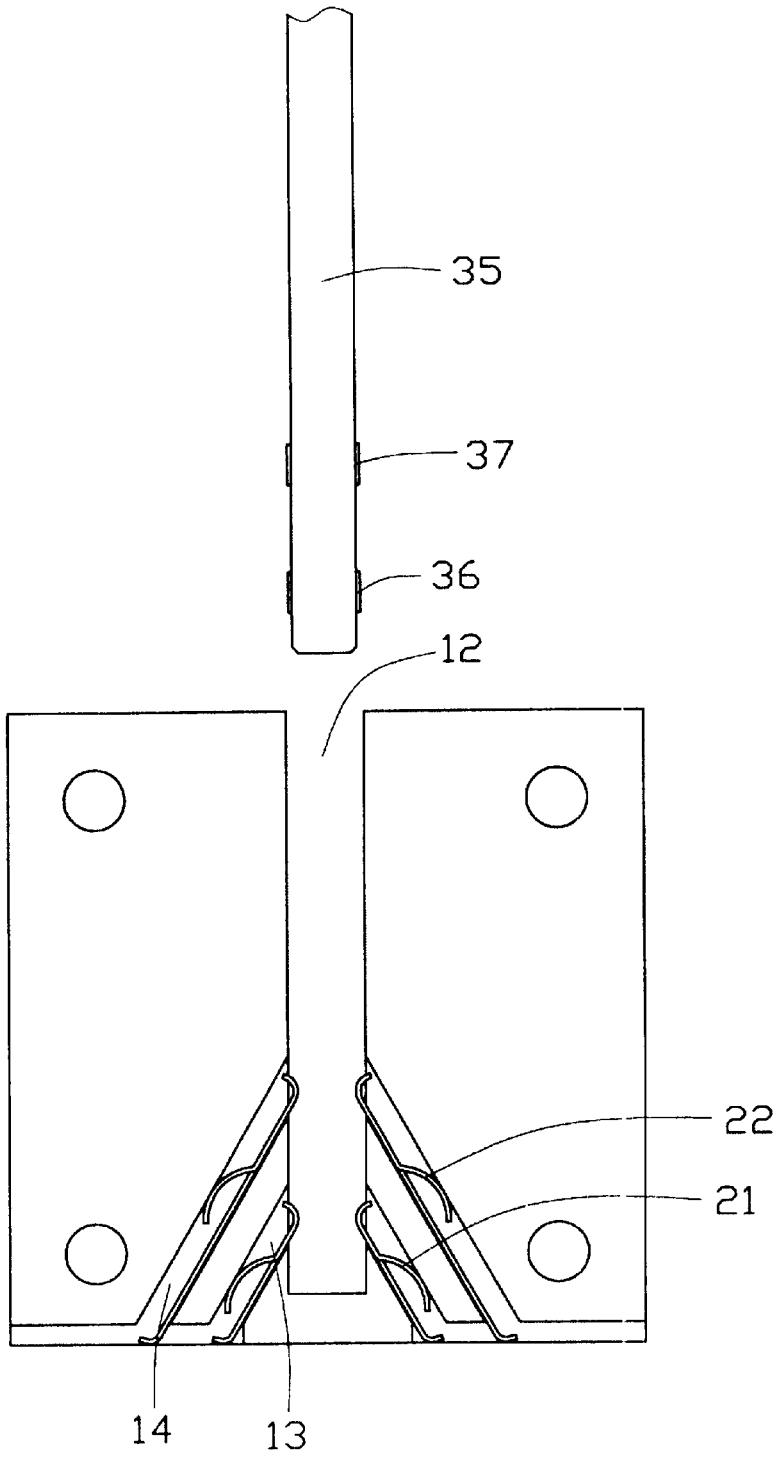
FIG. 5A to 5C are illustrations showing the daughter card is electrically connected to the mother board via the connector in accordance with the present invention.
Figure 5B:
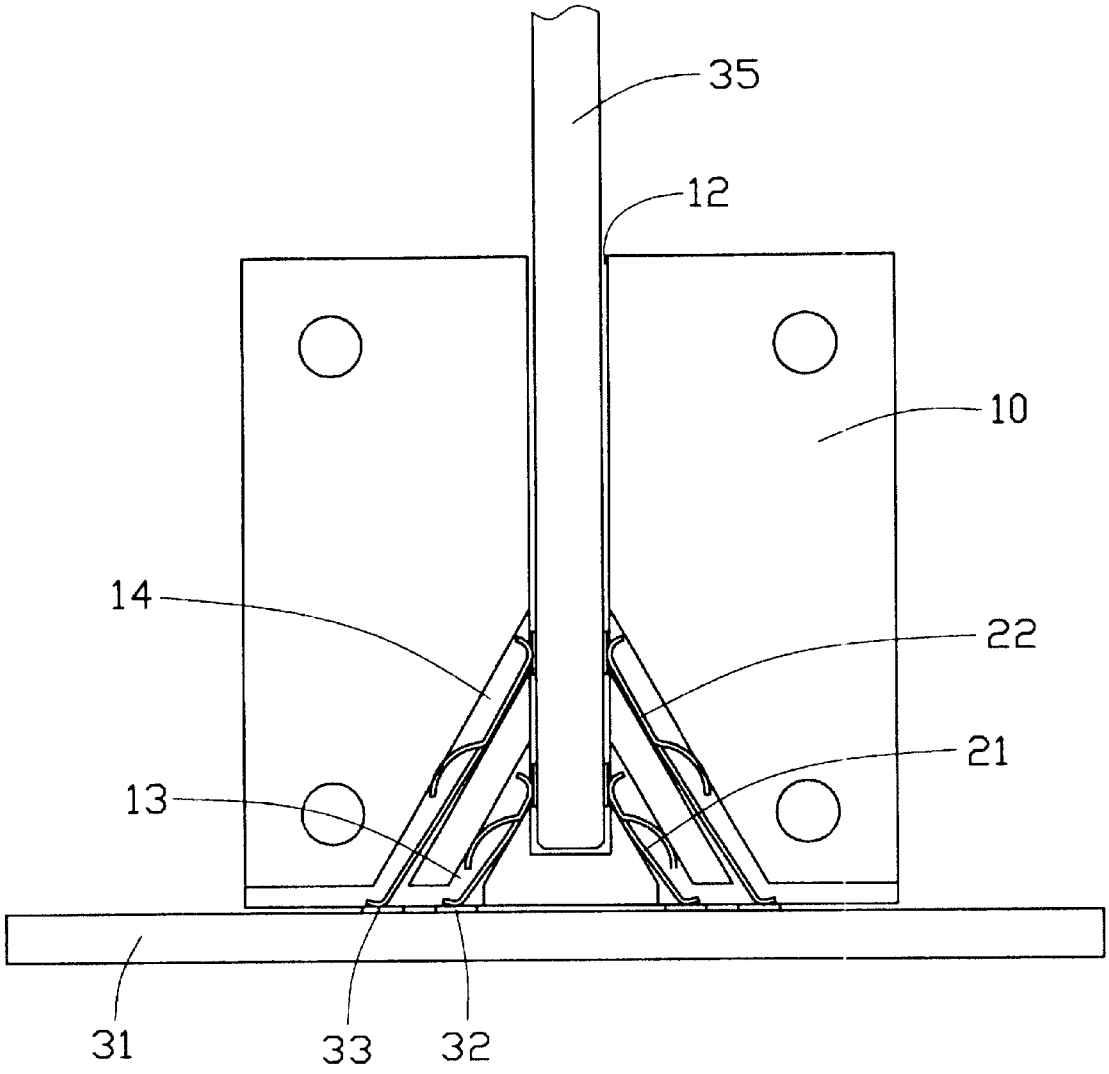
Figure 5C:
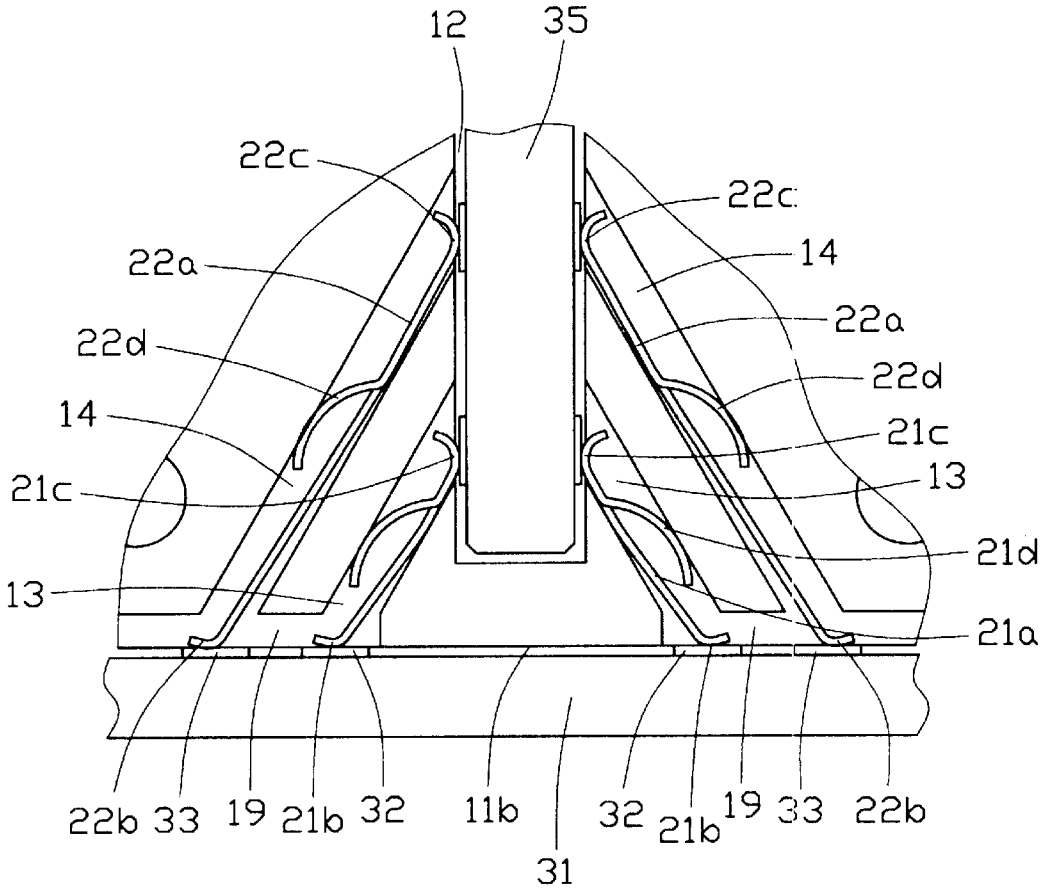

FIGS. 5A to 5C detailedly illustrate how the daughter card 35 is electrically connected to a mother board 31 by the connector 1 disclosed above.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a plurality of wafers stacked one another;

each wafer defining a base portion having at least a first passageway extending through first and second sides thereof, and a terminal moveably received in said passageway having at least an end contacting portion extending beyond said first side;

wherein said terminal includes a projection extending away from a main portion of the terminal; said projection abuts against a side of the passageway thereby supporting the terminal within the passageway;

wherein each wafer defines a card receiving passageway in parallel to said first side and in communication with said first passageway;

wherein each wafer defines a second passageway in communication with said card receiving passageway;

wherein said first and second passageways are mirror imaged with respect to said card receiving passageway;

wherein each wafer further defining third and fourth passageways arranged in mirror-image with respect to said card receiving passageway; and wherein a recess defined in said second side and merging with an end portion of said Passageway, wherein a second end portion of said terminal extends from said recess for contacting a conductive pad of a printed circuit board.

2. The electrical connector as described in claim 1, wherein said projection is an arm.

3. The electrical connector as described in claim 1, wherein said projection is lengthened from a portion of the terminal.

* * * * *